US005415094A

United States Patent [19]

Morrone

[11] Patent Number: 5,415,094

[45] Date of Patent: May 16, 1995

[54] APPARATUS AND METHOD FOR INKING OF AN ENGRAVING DIE UTILIZING A SELECTIVELY ROTATABLE INKING ROLLER WITH EXTERNAL RIBBING THEREON

[76] Inventor: Ross F. Morrone, 22 Hamilton Ave., Cranford, N.J. 07016

[21] Appl. No.: 137,335

[22] Filed: Oct. 18, 1993

[51] Int. Cl.[6] ..... B41F 31/00

[52] U.S. Cl. ..... 101/327; 101/329

[58] Field of Search ..... 101/327, 348, 349, 350, 101/329, 161, 321, 314, 326, 315, 320, 353–356, 359, 360, 363

[56] References Cited

U.S. PATENT DOCUMENTS

| | | | |
|---|---|---|---|
| 1,860,957 | 5/1932 | Rutkoskie | 101/353 |
| 2,351,030 | 6/1941 | Fernandez | 101/161 |
| 3,348,481 | 10/1967 | Nowak | 101/269 |
| 3,877,368 | 4/1975 | Madigan | 101/147 |
| 3,924,313 | 12/1975 | Broderick | 29/121 |
| 4,024,813 | 5/1977 | Thiene et al. | 101/354 |
| 4,207,818 | 6/1980 | Hamisch | 101/205 |
| 4,387,645 | 6/1983 | Holland-Letz et al. | 101/314 |
| 4,452,141 | 6/1984 | Mistyurik | 101/348 |
| 4,478,146 | 10/1984 | Mistyurik | 101/205 |
| 4,509,426 | 4/1985 | Hardin | 101/348 |
| 4,559,873 | 12/1985 | Godlewski | 101/329 |
| 4,567,827 | 2/1986 | Fadner | 101/350 |
| 4,627,349 | 12/1986 | Claussen | 101/348 |
| 4,712,475 | 12/1987 | Kemmerer et al. | 101/348 |
| 4,718,344 | 1/1988 | Lemaster | 101/348 |
| 4,756,249 | 7/1988 | Hardin | 101/348 |
| 4,782,756 | 11/1988 | Howard | 101/425 |
| 4,785,514 | 11/1988 | Kannwischer | 29/116 |
| 4,829,645 | 5/1989 | Kannwischer | 29/123 |
| 4,833,987 | 5/1989 | Hardin | 101/348 |
| 4,862,799 | 9/1989 | Hyener et al. | 101/348 |
| 4,869,167 | 9/1989 | Villarreal | 101/348 |
| 4,879,791 | 11/1989 | Herb | 29/148.4 |
| 4,882,990 | 11/1989 | Ijichi | 101/348 |
| 4,887,533 | 12/1989 | Lemaster et al. | 101/492 |
| 4,939,994 | 7/1990 | Puleston | 101/348 |
| 4,967,663 | 11/1990 | Metcalf | 101/348 |
| 4,986,181 | 1/1991 | Kobayashi et al. | 101/348 |
| 5,001,821 | 3/1991 | Herb | 29/121.2 |
| 5,065,676 | 11/1991 | Hardin | 101/349 |
| 5,093,180 | 3/1992 | Morgan | 428/156 |
| 5,099,759 | 3/1992 | Sonobe et al. | 101/348 |
| 5,113,760 | 5/1992 | Sonobe et al. | 101/348 |
| 5,184,552 | 2/1993 | Ijichi | 101/348 |

OTHER PUBLICATIONS

Bruce E. Thayer, "Photoreceptor Toner Cleaning Member", Xerox Disclosure Journal, vol. 4, No. 5, Sep./Oct., 1979 p. 665.

*Primary Examiner*—Edgar S. Burr
*Assistant Examiner*—Anthony H. Nguyen
*Attorney, Agent, or Firm*—Sperry, Zoda & Kane

[57] ABSTRACT

An inking roller which includes a plurality of ribs on the exterior thereof and a plurality of recesses for holding ink in between the individual ribs. The inking roller is adapted to be rotated upon contact with a conventional ink fountain and is selectively capable of being locked to prevent rotation thereof at certain times when in contact with the engraving die. The inking roller is adapted to apply engraving ink to the engraving die in the engraving areas thereof and is adapted to wipe the non-engraving areas of the engraving die with the external ribbing on the exterior surface of the cylindrical inking roller.

22 Claims, 3 Drawing Sheets

APPARATUS AND METHOD FOR INKING OF AN ENGRAVING DIE UTILIZING A SELECTIVELY ROTATABLE INKING ROLLER WITH EXTERNAL RIBBING THEREON

BACKGROUND OF THE INVENTION

1. Field Of The Invention

The present invention deals with the field of devices utilized for printing. More particularly the present invention deals with the field of devices for printing utilizing an engraving die. The present invention is further particularly applicable to a novel means for inking and wiping of an engraving die in order to place engraving ink in the engraving areas thereof and to minimize wastage of ink and wastage of die wiping members such as paper wipes or the like.

The conventional engraving press includes a fountain for supplying of engraving ink as well as a moving member for moving of the inking means from the fountain to a position adjacent to the engraving die to facilitate inking thereof. The conventional design also includes a means of removing of excess ink from the engraving die such as by paper wiping thereof.

2. Description Of The Prior Art

Many prior art devices have been designed for the inking of printing dies and examples of such are shown in U.S. Pat. No. 3,877,368 patented Apr. 15, 1975 to T. Madigan and assigned to Itek Corporation on an "Ink Transfer Roller For Printing Presses"; and U.S. Pat. No. 3,924,313 patented Dec. 9, 1975 to F. Broderick and assigned to Standex International Corporation on a "Metal Applicator Roll"; and U.S. Pat. No. 4,452,141 patented Jun. 5, 1984 to J. Mistyurik and assigned to Monarch Marking Systems, Inc. on a "Fountain-Type Porous Roller With Central Bearing Flange"; and U.S. Pat. No. 4,478,146 patented Oct. 23, 1984 to J. Mistyurik and assigned to Monarch Marking Systems, Inc. on an "Ink Roller Support With Pivotable Cover"; and U.S. Pat. No. 4,509,426 patented Apr. 9, 1985 to P. Hardin on an "Autoreversing Dual Axial Speed Ink Roller"; and U.S. Pat. No. 4,559,873 patented Dec. 24, 1985 to E. Godlewski on an "Inking Roller Assembly"; and U.S. Pat. No. 4,567,827 patented Feb. 4, 1986 to T. Fadner and assigned to Rockwell International Corporation on a "Copper And Nickel Layered Ink Metering Roller" and U.S. Pat. No. 4,627,349 patented Dec. 9, 1986 to G. Claussen on a "Heated Inking Roll For A Printer"; and U.S. Pat. No. 4,712,475 patented Dec. 15, 1987 to K. Kemmerer et al and assigned to M.A.N.-Roland Druckmaschinen Aktiengesellschaft on an "Inking Roller For Printing Machines"; and U.S. Pat. No. 4,718,344 patented Jan. 12, 1988 to M. Lemaster on an "Apparatus And Method For Oscillating The Form Rollers In A Printing Press"; and U.S. Pat. No. 4,756,249 patented Jul. 12, 1988 to P. Hardin on a "Self-Adjusting Means For Rollers"; and U.S. Pat. No. 4,782,756 patented Nov. 8, 1988 to P. Howard on a "Printing Press Roller Ink Remover"; and U.S. Pat. No. 4,785,514 patented Nov. 22, 1988 to K. Kannwischer and assigned to HH&L Co. on an "Oscillating Roller Mounted On A Fixed Shaft"; and U.S. Pat. No. 4,829,645 patented May 16, 1989 to K. Kannwischer and assigned to HH&L Co. on an "Oscillating Roller"; and U.S. Pat. No. 4,833,987 patented May 30, 1989 to P. Hardin on an "Axially Oscillating Ink Distributing Roller Having A Unitary Rocker Follower"; and U.S. Pat. No. 4,862,799 patented Sep. 5, 1989 to S. Hyener and assigned to Rockwell International Corporation on a "Copper Coated Anodized Aluminum Ink Metering Roller"; and U.S. Pat. No. 4,869,167 patented Sep. 26, 1989 to J. Villarreal and assigned to Royse Engineering, Inc. on a "Variable Speed Oscillating Roller"; and U.S. Pat. No. 4,879,791 patented Nov. 14, 1989 to R. Herb and assigned to Albert-Frankenthal AG on a "Method Of Producing A Pitted Roll For An Offset Litho Printing Press"; and U.S. Pat. No. 4,882,990 patented Nov. 28, 1989 to Y. Ijichi and assigned to Rockwell International Corporation on an "Ink Roller For Rotary Press"; and U.S. Pat. No. 4,887,533 patented Dec. 19, 1989 to M. Lemaster et al and assigned to AirSystems Inc. on an "Apparatus And Method For Oscillating The Form Rollers In A Printing Press"; and U.S. Pat. No. 4,939,994 patented Jul. 10, 1990 to S. Puleston and assigned to Borden, Inc. on an "Engraved Printing Rolls"; and U.S. Pat. No. 4,967,663 patented Nov. 6, 1990 to R. Metcalf and assigned to Coors Porcelain Company on an "Unengraved Metering Roll Of Porous Ceramic"; and U.S. Pat. No. 4,986,181 patented Jan. 22, 1991 to T. Kobayashi et al and assigned to Kubota Ltd and Kabushikigaisha Tokyo Kikai Seisakusho on "Rollers For A Lithographic Ink Supplying System"; and U.S. Pat. No. 5,001,821 patented Mar. 26, 1991 to R. Herb and assigned to Albert-Frankenthal AG on a "Pitted Roll For An Offset Litho Printing Press"; and U.S. Pat. No. 5,065,676 patented Nov. 19, 1991 to P. Hardin on an "Axially Reversing Roller For Printing Presses And Sheet Coating Machines"; and U.S. Pat. No. 5,093,180 patented Mar. 3, 1992 to R. Morgan and assigned to Union Carbide Coatings Service Technology Corporation on "Liquid Transfer Articles And Method For Producing Them"; and U.S. Pat. No. 5,099,759 patented Mar. 31, 1992 to S. Sonobe and assigned to Kinyosha Co., Ltd. on an "Ink Metering Roller And Method Of Manufacturing The Same"; and U.S. Pat. No. 5,113,760 patented May 19, 1992 to S. Sonobe et al and assigned to Kinyosha Co., Ltd. on an "Ink Roller For Printing Machine"; and U.S. Pat. No. 5,184,552 patented Feb. 9, 1993 to Y. Ijichi and assigned to Rockwell International Corporation on an "Ink Roller For Rotary Press".

SUMMARY OF THE INVENTION

The present invention provides an apparatus and method for applying engraving ink to an engraving die member for use with a standard engraving press having an engraving ink fountain therein to supply engraving ink for engraving. The design includes a system whereby the inking roller is initially placed in abutment with respect to the engraving ink fountain for movement of ink thereon. Preferably the inking roller includes a configuration having a plurality of external ribs on the outer cylindrical surface thereof and defines a plurality of engraving ink receiving recesses between the external ribs. Preferably the inking roller is formed of a polyurethane material.

The inking roller is then rotated merely by contacting the fountain or can be separately power driven to cause rotation thereof in order to supply engraving ink from the ink fountain over the external surface of the inking roller including the external ribs thereof and the ink receiving recesses defined on the exterior thereof.

A carriage assembly which is movable between an ink pick-up position with the inking roller adjacent to the engraving ink fountain and an ink application position wherein the inking roller is immediately adjacent the path of movement of the engraving die itself.

The movable carriage includes an arbor member with the inking roller mounted thereon. The inking roller is moved by the movable carriage assembly to a position adjacent to the engraving die. At this point the inking roller is locked to prevent rotation thereof by engagement of the locking mechanism thereof. The engraving die is then moved in a horizontal direction past the inking roller for simultaneously inking and wiping of the engraving die while contacting the external ribs on the outer cylindrical surface of the roller. In this manner engraving ink will be forced into the engraving areas of the engraving die and ink will be wiped by the external ribs from the non-engraving surfaces of the engraving die. An additional step of paper wiping of the engraving die may now be included if necessary to finally remove any remaining excess ink. Once the engraving die has been properly inked the locking mechanism associated with the inking roller is disengaged to allow rotational movement of the inking roller as desired. The inking roller is then moved by the movable carriage from the path of movement of the engraving die which is the ink application position to return to the ink pick-up position adjacent to the inking fountain. Thereafter the engraving die is placed in abutment with respect to the desired substrate to facilitate engraving thereof and the system is ready for another cycle of the procedure.

It is an object of the present invention to provide a method and apparatus for inking of an engraving die utilizing a cylindrically rotatable inking roller with external ribbing thereon which minimizes engraving ink wastage.

It is an object of the present invention to provide a method and apparatus for inking of an engraving die utilizing a cylindrically rotatable inking roller with external ribbing thereon which allows conversion of original equipment factory material with a minimum of additional parts.

It is an object of the present invention to provide a method and apparatus for inking of an engraving die utilizing a cylindrically rotatable inking roller with external ribbing thereon which carefully and efficiently provides for movement of an inking roller between the ink pick-up position adjacent the inking fountain and the ink application position adjacent to the path of movement of the engraving die.

It is an object of the present invention to provide a method and apparatus for inking of an engraving die utilizing a cylindrically rotatable inking roller with external ribbing thereon which simultaneously inks and wipes an engraving die to facilitate engraving thereby.

It is an object of the present invention to provide a method and apparatus for inking of an engraving die utilizing a cylindrically rotatable inking roller with external ribbing thereon which recovers unused ink from the engraving die for reuse thereof.

It is an object of the present invention to provide a method and apparatus for inking of an engraving die utilizing a cylindrically rotatable inking roller with external ribbing thereon which allows for easy and simple replacement of the inking roller outer sleeve when desired.

It is an object of the present invention to provide a method and apparatus for inking of an engraving die utilizing a cylindrically rotatable inking roller with external ribbing thereon which has minimal maintenance requirements.

It is an object of the present invention to provide a method and apparatus for inking of an engraving die utilizing a cylindrically rotatable inking roller with external ribbing thereon which minimizes down time.

It is an object of the present invention to provide a method and apparatus for inking of an engraving die utilizing a cylindrically rotatable inking roller with external ribbing thereon which requires a minimum initial capital outlay for conversion of a press.

It is an object of the present invention to provide a method and apparatus for inking of an engraving die utilizing a cylindrically rotatable inking roller with external ribbing thereon which facilitates inking of a moving engraving die.

It is an object of the present invention to provide a method and apparatus for inking of an engraving die utilizing a cylindrically rotatable inking roller with external ribbing thereon which minimizes usage of conventionally used paper die wiping members.

It is an object of the present invention to provide a method and apparatus for inking of an engraving die utilizing a cylindrically rotatable inking roller with external ribbing thereon which forces ink into all of the engraving areas of the engraving die.

It is an object of the present invention to provide a method and apparatus for inking of an engraving die utilizing a cylindrically rotatable inking roller with external ribbing thereon which maximizes cleanliness in the engraving process.

It is an object of the present invention to provide a method and apparatus for inking of an engraving die utilizing a cylindrically rotatable inking roller with external ribbing thereon which minimizes the accumulation and drying of ink within an engraving press.

It is an object of the present invention to provide a method and apparatus for inking of an engraving die utilizing a cylindrically rotatable inking roller with external ribbing thereon which utilizes wiper ribs which simultaneously force ink into the engraved areas and clean the non-engraving areas of the die surface simultaneously.

It is an object of the present invention to provide a method and apparatus for inking of an engraving die utilizing a cylindrically rotatable inking roller with external ribbing thereon which is usable with any standard inking fountain.

It is an object of the present invention to provide a method and apparatus for inking of an engraving die utilizing a cylindrically rotatable inking roller with external ribbing thereon which is usable with any standard engraving die.

It is an object of the present invention to provide a method and apparatus for inking of an engraving die utilizing a cylindrically rotatable inking roller with external ribbing thereon which requires no additional learning skills by an engraving press operator.

It is an object of the present invention to provide a method and apparatus for inking of an engraving die utilizing a cylindrically rotatable inking roller with external ribbing thereon which significantly lowers the operating cost of an engraving press by minimizing consumption of ink significantly.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

The present invention provides an apparatus useful for inking of an engraving die of an engraving press which uses a selectively rotatable inking roller with an external ribbing thereon for simultaneously supplying ink to the engraving die and wiping of the non-engraving areas thereof.

Figure 5:
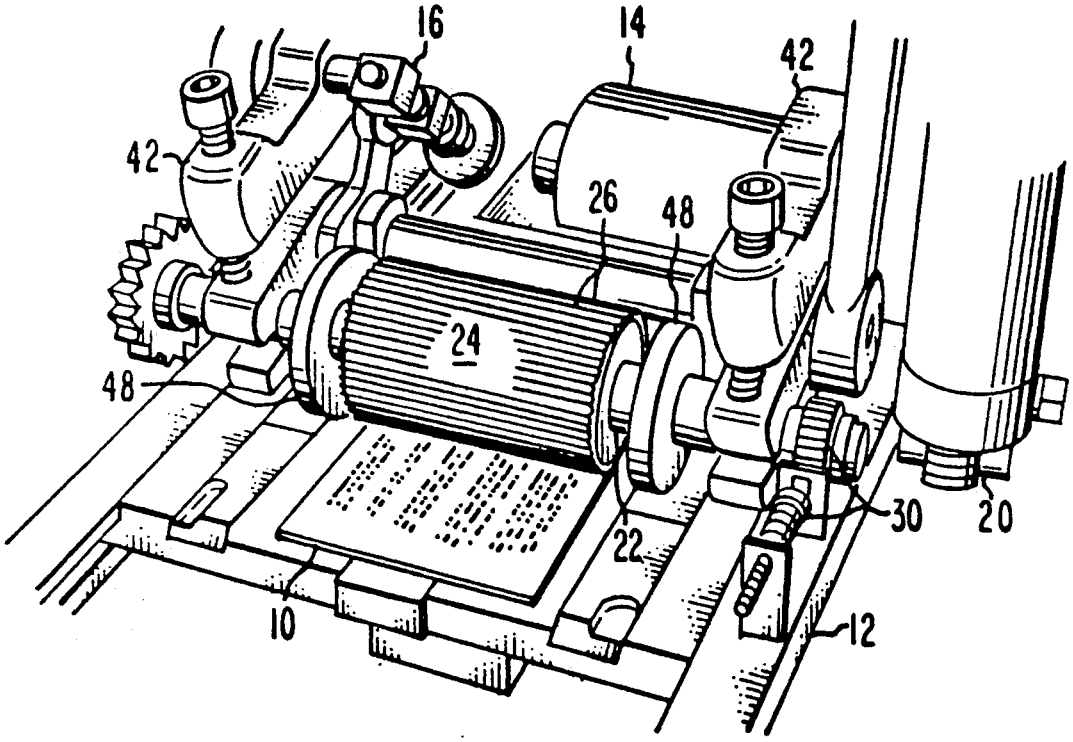
FIG. 5 is an illustration of an embodiment of the engraving press of the present invention shown with the carriage assembly in the ink application position.
Figure 6:
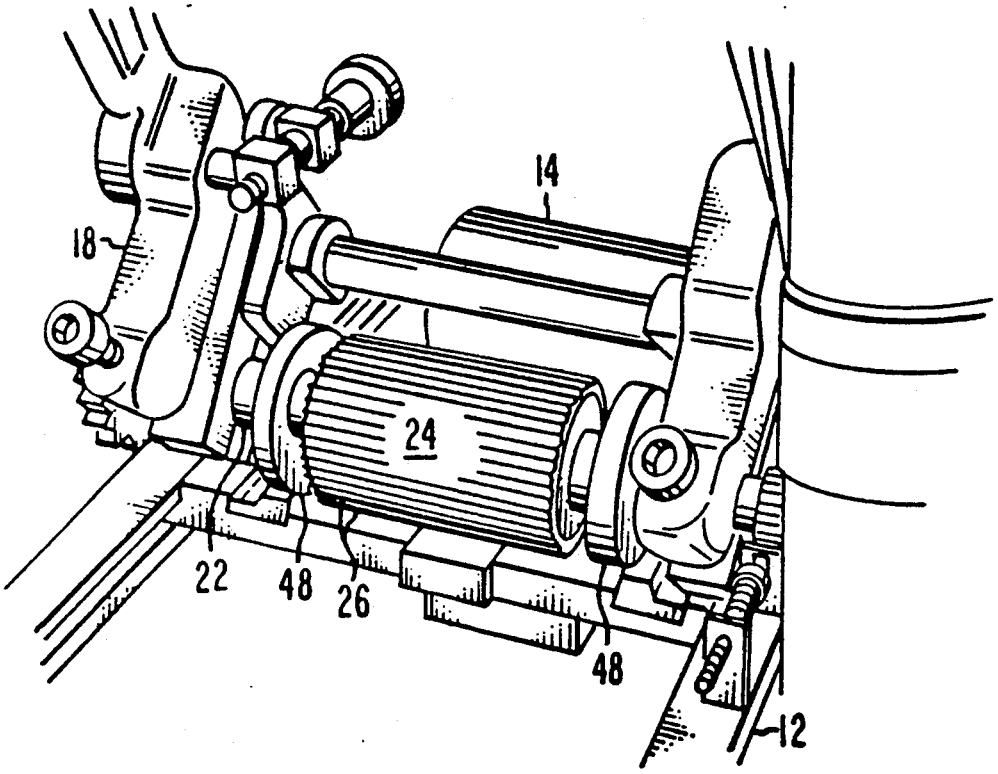
FIG. 6 is an illustration of the configuration shown in FIG. 5 with the carriage assembly shown in the ink pick-up position.

The engraving press 12 of the present invention as shown best in FIGS. 5 and 6 includes an engraving die 10 which is movable to facilitate inking thereof and to facilitate engraving printing on a desired substrate such as stationery or the like. The engraving press 12 includes an ink fountain 14 for providing a supply of engraving ink for inking of the engraving die 10 after each printing thereby.

The present invention provides a movable carriage assembly 16 which includes an arbor member 22 mounted thereon with an inking roller member 24 mounted upon the arbor member 22. The inking roller member preferably includes an outer sleeve member 36 which includes a plurality of external ribs 26 defined thereon. Ink receiving recesses 28 are defined between each adjacent pair of external ribs 26 to facilitate retaining of ink on the external surface of the inking roller member 24.

The carriage assembly 16 is movable between an ink pick-up position 18 as shown best in FIG. 6. At this position ink is supplied from the ink fountain 14 to the external surface of the inking roller 24. At this location it is desirable to allow the inking roller 24 and the arbor member 22 upon which it is mounted to be rotatable to facilitate the movement of ink from the inking fountain 14 to the entire circumference of the outer surface of the inking roller 24. To facilitate this inking it may be necessary to include a fountain drive gear 34 fixedly secured to one end of the arbor member 22 as shown best in FIG. 2. This fountain drive gear 34 is adapted to engage a drive mechanism within the ink fountain 14 for providing a driving mechanism for positively driving the rotational movement of the inking roller member 24 with respect to the ink fountain 14 to facilitate inking of the entire outer sleeve member 36 thereof.

The carriage assembly 16 is movable from the ink pick-up position 18 to an ink application position 20. In the ink application position 20 the carriage assembly 16 is adapted to position the inking roller 24 adjacent to the path of movement of the engraving die 10.

Preferably the engraving die 10 is movable in a horizontal linear direction such as to tangentially contact the external surface of the cylindrical inking roller 24 to receive ink therefrom.

As the engraving die 10 passes under the inking roller 24 as shown best in FIG. 5 the ink which is located within the ink retaining recesses 28 will be pushed into the engraving depressions within the engraving die. The external ribs 26 will aid in urging of the ink from the ink retaining recesses 28 into the engraving areas of the engraving die 10. Simultaneously the external ribs 26 will wipe the non-engraving portions of the engraving die 10 thereby returning most of the ink located thereon back onto the inking roller member 24 for reuse in a subsequent inking operation.

It is preferable to prevent rotation of the inking roller member 24 while the engraving die 10 is in contact therewith and as such a locking mechanism 30 may be included. Locking mechanism 30 is adapted to lock the inking roller member 24 to prevent rotational movement thereof whenever the carriage assembly 16 has moved to the ink application position 20 with the inking roller member 24 positioned adjacent to the path of movement of the engraving die 10. This locking mechanism 30 preferably includes a toothed locking hub 32 shown best in FIG. 2 which is fixedly attached with respect to the arbor member 22 to thereby facilitate locking of arbor member 22 against rotation or to release the arbor member to allow for rotation thereof as desired.

It is preferable that the outer sleeve member 36 of the inking roller member 24 be formed of a molded polyurethane material to facilitate the wiping by the external ribs 26 and to facilitate the holding of engraving ink within the ink retaining recesses 28 defined therebetween.

Figure 1:
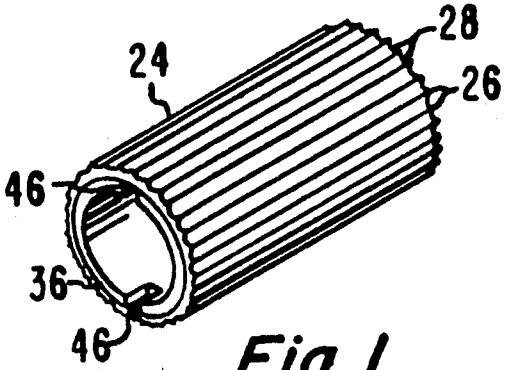
FIG. 1 is a perspective view of an embodiment of an outer sleeve of an inking roller of the present invention.
Figure 2:
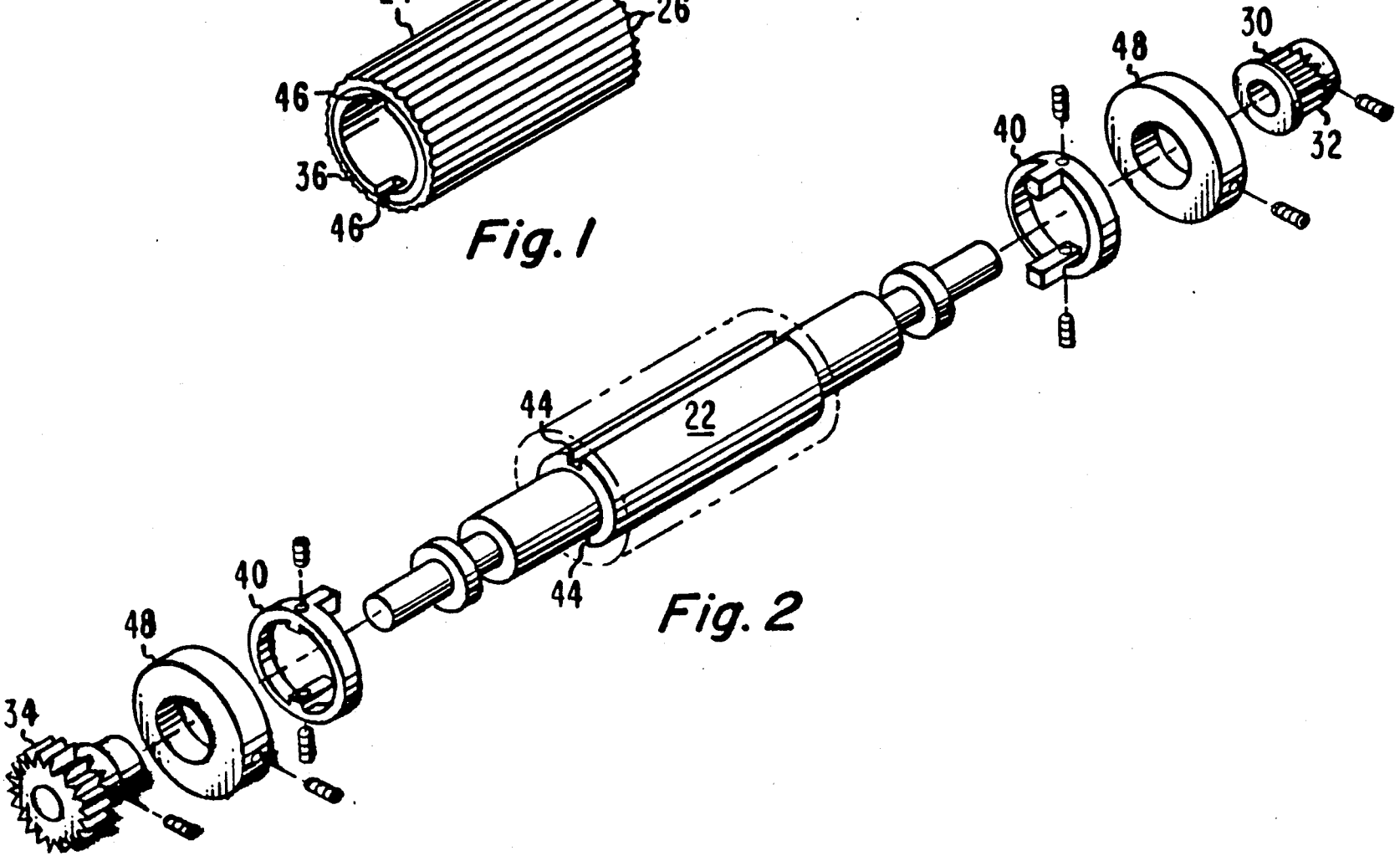
FIG. 2 is an exploded view of an embodiment of the arbor of the present invention showing embodiments of the retainer ring, contact disc, locking hub and fountain gear assembled thereon.
Figure 3:
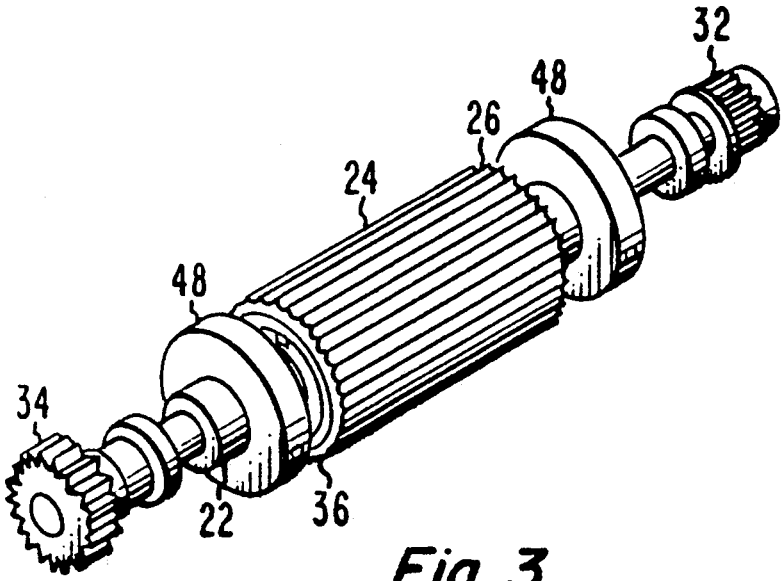
FIG. 3 is a perspective illustration of an embodiment of the outer sleeve and embodiment of the arbor fully assembled.
Figure 4:
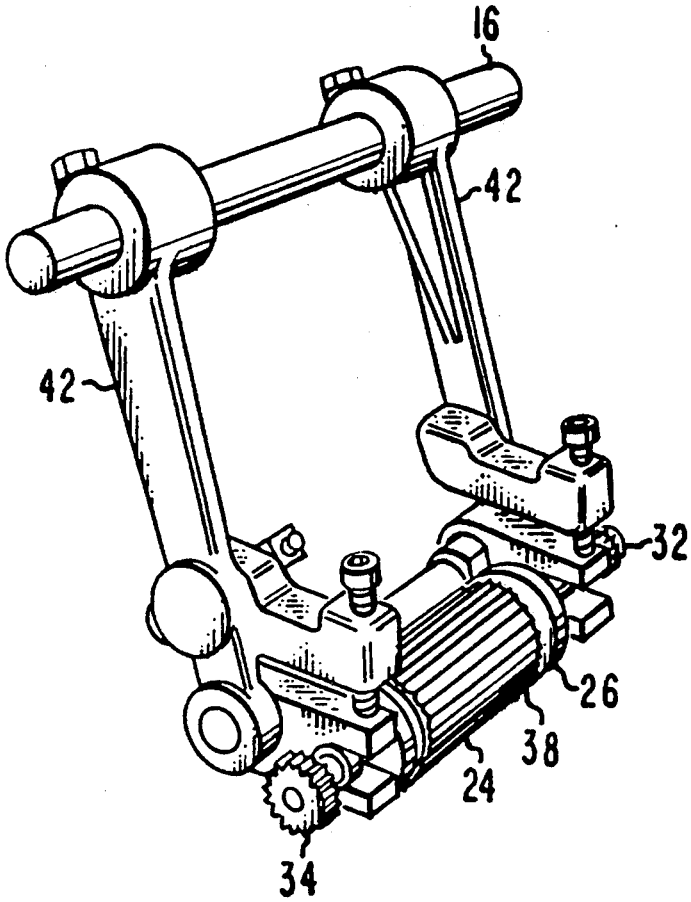
FIG. 4 is a perspective illustration of an embodiment of the carriage assembly of the present invention shown with the inking member attached thereto.

As shown in FIGS. 1 and 2 the assembly of the inking roller member 24 upon the arbor member 22 can be facilitated by the use of a retaining ring means 40. With this configuration an arbor slot 44 is defined longitudinally in the arbor member 22 and a roller slot 46 is defined longitudinally in the inking roller member 24. With these slot means 44 and 46 registered with respect to one another the retaining ring means 40 will extend therein to lock the slot 44 and the slot 46 with respect to one another and thereby facilitate locking of the inking roller 24 with respect to the arbor member 22.

Preferably the carriage assembly 16 of the present invention includes a U-shaped yolk member 42 to facilitate holding of the arbor member 22 at opposite axial points therealong to accurately control movement thereof. Furthermore movement and positioning of the inking roller member 24 is achieved by the use of contact discs 48 as shown best in FIG. 2 which can be positioned traveling within camming areas outside the area of engraving to accurately control positioning of the inking roller member 24 with respect to the engraving die 10 as it passes therealong.

As such, the present invention is particularly useful in the use of an inking roller member 24 having the unique configuration of a plurality of external ribs 26 defined thereon and a plurality of ink retaining recesses 28 located between the adjacent ribs. Furthermore the method of the present invention is particularly useful in view of the rotating characteristics of the inking roller member 24 which is locked against rotation by the locking mechanism 30 during actual application of ink onto the engraving die 10 while at the same time the inking roller member 24 is completely free for rotation at all other times in the process and in fact can actually be driven to rotate when in contact with the ink fountain 14 to facilitate movement of ink onto the exterior surface thereof.

Under certain engraving conditions it may be necessary for the engraving die 10 to receive an initial additional application of ink prior to final wiping by the inking roller member 24 of the present invention. The same apparatus can be utilized for this purpose. However the locking mechanism 30 will be selective such as to be capable of being in the locked or unlocked position when the inking roller member 24 is positioned adjacent to the inking die 10. With this procedure an initial pass of the engraving die 10 in abutment with the inking roller 24 will be performed with the inking roller 24 unlocked. With this configuration the engraving die 10 will then be again passed in abutment with the inking roller member 24 a final time with the inking roller locked to thereby provide a final application of ink to the engraving die and also simultaneously wipe the engraving die.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A method for inking an engraving die utilizing a selectively rotatable inking roller with external ribbing thereon comprising:

A. placing an inking roller having external ribs on the outer cylindrical surface thereof adjacent to a source of engraving ink;

B. rotating the inking roller adjacent to the source of engraving ink to apply engraving ink over the external ribs of the inking roller;

C. moving the inking roller with engraving ink on the external ribs thereof adjacent to the path of movement of the engraving die;

D. locking the inking roller to prevent rotational movement thereof;

E. moving the engraving die past the inking roller for simultaneously inking and wiping the engraving die while contacting the external ribs on the outer cylindrical surface thereof to facilitate applying engraving ink to the engraving areas of the engraving die and wiping ink by the external ribs from the non-engraving surfaces of the engraving die;

F. unlocking the inking roller to allow rotational movement thereof; and

G. removing the inking roller from the path of movement of the engraving die.

2. A method for inking an engraving die utilizing a selectively rotatable inking roller with external ribbing thereon as defined in claim 1 wherein said simultaneously inking and wiping the engraving die is achieved by moving it in a linear path past the inking roller while contacting the external ribs thereon.

3. A method for inking an engraving die utilizing a selectively rotatable inking roller with external ribbing thereon as defined in claim 1 wherein said rotating the inking roller is performed in a positive power driven manner.

4. A method for inking an engraving die utilizing a selectively rotatable inking roller with external ribbing thereon as defined in claim 1 wherein said rotating the inking roller adjacent to the source of engraving ink is performed with the inking roller in abutment with the source of engraving ink.

5. A method for inking an engraving die utilizing a selectively rotatable inking roller with external ribbing thereon as defined in claim 1 wherein said moving the engraving die past the inking roller is performed in approximately a horizontal direction.

6. A method for inking an engraving die utilizing a selectively rotatable inking roller with external ribbing thereon as defined in claim 1 further including forcing engraving ink into the engraving areas of the engraving die by the ribs located on the outer cylindrical surface of the inking roller prior to wiping.

7. A method for inking an engraving die utilizing a selectively rotatable inking roller with external ribbing thereon as defined in claim 1 wherein said locking the inking roller is achieved by moving of the inking roller assembly into engagement with respect to a locking pin.

8. A method for inking an engraving die utilizing a selectively rotatable inking roller with external ribbing thereon as defined in claim 1 further including contacting the engraving die with respect to a substrate for engraving thereof after removing the inking roller from the path of movement of the engraving die.

9. A method for inking an engraving die utilizing a selectively rotatable inking roller with external ribbing thereon as defined in claim 1 further comprising wiping the engraving die with paper material to remove excess engraving ink therefrom after moving the engraving die past the inking roller.

10. A method for inking an engraving die utilizing a selectively rotatable inking roller with external ribbing thereon as defined in claim 1 further including initial inking the engraving die by movement thereof into abutment with said inking roller prior to locking said inking roller for an initial application of ink to the engraving die prior to locking the inking roller and the final simultaneous inking and wiping of the engraving die.

11. A method for inking an engraving die utilizing a selectively rotatable inking roller with external ribbing thereon comprising:

A. placing an inking roller having external ribs on the outer cylindrical surface thereof in abutment with respect to an engraving ink fountain;

B. power driven rotating the inking roller adjacent to the engraving ink fountain to apply engraving ink over the external ribs of the inking roller;

C. moving the inking roller with engraving ink on the external ribs thereof adjacent to the path of movement of the engraving die;

D. locking the inking roller to prevent rotational movement thereof by attaching the inking roller with respect to a locking pin;

E. moving the engraving die in a horizontal direction past the inking roller for simultaneously inking and wiping the engraving die while contacting the external ribs on the outer cylindrical surface thereof to facilitate forcing engraving ink to the engraving areas of the engraving die and wiping ink by the external ribs from the non-engraving surfaces of the engraving die;

F. paper wiping the engraving die to further remove excess engraving ink therefrom prior to engraving therewith;

G. unlocking the inking roller to allow rotational movement thereof;

H. removing the inking roller from the path of movement of the engraving die; and I. placing the engraving die in abutment with respect to a substrate for engraving thereof.

12. An apparatus for inking of an engraving die member for use with a conventional engraving press having an engraving die and an engraving ink fountain, said inking apparatus comprising:

A. a moveable carriage assembly being moveable between an ink pick-up position for receiving ink from an engraving ink fountain and an ink application position for applying of ink onto an engraving die;

B. an arbor member movably mounted on the said moveable carriage assembly and being rotatably with respect thereto;

C. an inking roller member mounted on said arbor member to be selectively rotatable therewith, said inking roller member being cylindrically shaped and including a plurality of external ribs on the external cylindrical surface thereof, said external ribs defining a plurality of ink retaining recesses therebetween, said inking roller member adapted to receive engraving ink into said ink retaining recesses thereof responsive to said moveable carriage assembly being in the ink pick-up position, said inking roller member being responsive to said moveable carriage assembly being in the ink application position to simultaneously apply engraving ink to and wipe an engraving die passing thereadjacent; and D. a locking mechanism attached with respect to said arbor member and being selectively capable to selectively prevent rotation of said arbor member and of said inking roller member responsive to said movably carriage assembly being in the ink application position.

13. An apparatus for inking of an engraving die member as defined in claim 12 further comprising a fountain drive gear fixedly secured to said arbor member and being adapted to selectively engage the engraving ink fountain for urging rotation of said arbor member and said inking roller responsive to movement of said moveable carriage assembly to the ink pick-up position with said inking roller member being positioned adjacent the engraving ink fountain.

14. An apparatus for inking of an engraving die member as defined in claim 12 wherein said inking roller member includes an outer sleeve member which defines said external ribs and said ink retaining recesses therebetween.

15. An apparatus for inking of an engraving die member as defined in claim 14 wherein said outer sleeve member is of molded polyurethane.

16. An apparatus for inking of an engraving die member as defined in claim 12 wherein said locking mechanism includes a toothed locking hub fixedly secured to said arbor member to facilitate locking to prevent rotational movement thereof.

17. An apparatus for inking of an engraving die member as defined in claim 12 further comprising a retaining ring means affixed to said arbor member to facilitate fixed securement of said inking roller with respect thereto.

18. An apparatus for inking of an engraving die member as defined in claim 12 wherein said moveable carriage assembly includes a U-shaped yoke member to facilitate moveable attachment of said arbor member and said inking roller member with respect thereto.

19. An apparatus for inking of an engraving die member as defined in claim 12 wherein said arbor member is generally cylindrical and wherein said inking roller member is tubular and is adapted to extend surrounding said arbor member to facilitate rotation therewith.

20. An apparatus for inking of an engraving die member as defined in claim 17 wherein said arbor member defines a longitudinally extending arbor slot means therein and wherein said inking roller member defines a longitudinally extending roller slot means therein, said retaining ring means adapted to extend into said arbor slot means and said roller slot means to affix said arbor member with respect to said inking roller member.

21. An apparatus for inking of an engraving die member as defined in claim 12 further comprising a contact disc means secured with respect to said arbor member to facilitate control of spacing between said inking roller member and the engraving die passing thereadjacent.

22. An apparatus for inking of an engraving die member for use with a conventional engraving press having an engraving die and an engraving ink fountain, said inking apparatus comprising:

A. a moveable carriage assembly being moveable between an ink pick-up position for receiving ink from an engraving ink fountain and an ink application position for applying of ink onto an engraving die, said moveable carriage assembly including a U-shaped yoke member;

B. an arbor member movably mounted to said U-shaped yoke member of the said moveable carriage assembly and being rotatably with respect thereto, said arbor member defining a longitudinally extending arbor slot means therein;

C. an inking roller member mounted on said arbor member to be selectively rotatable therewith, said inking roller member being cylindrically shaped and including a plurality of external ribs on the external cylindrical surface thereof, said external ribs defining a plurality of ink retaining recesses therebetween, said inking roller member adapted to receive engraving ink into said ink retaining recesses thereof responsive to said moveable carriage assembly being in the ink pick-up position, said inking roller member being responsive to said moveable carriage assembly being in the ink application position to simultaneously apply engraving ink to and wipe an engraving die passing thereadjacent, said inking roller member including an outer sleeve member of polyurethane which defines said external ribs and said ink retaining recesses therebetween, said inking roller member defining a longitudinally extending roller slot means therein;

D. a locking mechanism attached with respect to said arbor member and being selectively operable to prevent rotation of said arbor member and of said inking roller member responsive to said movably carriage assembly being in the ink application position, said locking mechanism further including a toothed locking hub fixedly secured to said arbor member to facilitate locking of said locking mechanism to selectively prevent rotation of said inking roller member;

D. a fountain drive gear fixedly secured to said arbor member and being adapted to selectively engage the engraving ink fountain for positively urging rotation of said arbor member and said inking roller responsive to movement of said moveable carriage assembly to the ink pick-up position with said inking roller member being positioned adjacent the engraving ink fountain;

F. retaining ring means affixed to said arbor member and adapted to extend into said arbor slot means and said roller slot means to fixedly secure said inking roller member with respect to said arbor member; and G. a contact disc means being fixedly secured with respect to said arbor member to facilitate control of spacing between said inking roller member and the engraving die passing thereadjacent.

* * * * *